US009346587B1

(12) United States Patent
Myers

(10) Patent No.: US 9,346,587 B1
(45) Date of Patent: May 24, 2016

(54) OVOID TOTE WITH SECURABLE DRAWERS

(71) Applicant: Cindy Elaine Myers, Surprise, AZ (US)

(72) Inventor: Cindy Elaine Myers, Surprise, AZ (US)

( * ) Notice: Subject to any disclaimer, the term of this patent is extended or adjusted under 35 U.S.C. 154(b) by 0 days.

(21) Appl. No.: 14/202,245

(22) Filed: Mar. 10, 2014

(51) Int. Cl.
*A45C 1/08* (2006.01)
*B65D 25/00* (2006.01)

(52) U.S. Cl.
CPC .. *B65D 25/00* (2013.01); *A45C 1/08* (2013.01)

(58) Field of Classification Search
CPC ..... A45C 1/08; A45C 5/08; A45C 5/065; A45C 13/02; A45C 13/08; A45C 15/04; A45C 15/06; A45C 11/16
USPC ..... 150/104, 107, 108, 100, 112, 117; 383/907; D2/224; 206/6.1, 581; D28/80, 81; 63/1.11
See application file for complete search history.

(56) References Cited

U.S. PATENT DOCUMENTS

| | | | | | |
|---|---|---|---|---|---|
| 369,000 | A * | 8/1887 | Eubank | 190/5 |
| 1,501,525 | A * | 7/1924 | Croswhite | 132/295 |
| 1,503,378 | A * | 7/1924 | Reid | 132/296 |
| 1,503,979 | A * | 8/1924 | Callahan | 206/0.81 |
| 2,937,680 | A * | 5/1960 | Dumas | 150/116 |
| 3,381,119 | A * | 4/1968 | Brickman et al. | 362/137 |
| 4,098,312 | A * | 7/1978 | McCain | 150/106 |
| 4,813,521 | A * | 3/1989 | Goldstone | 190/120 |
| 5,025,817 | A * | 6/1991 | Wen | 132/296 |
| 5,832,941 | A * | 11/1998 | Murillo | 132/316 |
| 6,860,386 | B2 * | 3/2005 | Wolf | 206/6.1 |
| 2006/0103275 | A1 * | 5/2006 | Chang | 312/290 |
| 2007/0007164 | A1 * | 1/2007 | Lord | 206/570 |
| 2008/0073007 | A1 * | 3/2008 | Zuesi-Kreuzer | 150/110 |
| 2009/0139878 | A1 * | 6/2009 | Wejrowski | 206/6.1 |
| 2012/0291233 | A1 * | 11/2012 | Wilkinson | 24/302 |
| 2013/0133795 | A1 * | 5/2013 | Zhou et al. | 150/104 |

FOREIGN PATENT DOCUMENTS

EP 0072005 A1 * 2/1983

* cited by examiner

*Primary Examiner* — Sue A Weaver
(74) *Attorney, Agent, or Firm* — Williams Intellectual Property; Benjamin F. Williams

(57) ABSTRACT

An ovoid tote with securable drawers reminiscent of a luxury, jeweled egg having an ovoid tote member, a domed lid, a circular mirror disposed upon an undersurface of the domed lid, a topmost compartment disposed underneath the domed lid, an upper compartment disposed underneath the topmost compartment, a lockable middle drawer disposed underneath the upper compartment, a lower compartment disposed underneath the middle drawer, and a plurality of leg members basally disposed to maintain the ovoid tote member in an upright situation when deposited upon an underlying surface, whereby the ovoid tote member with securable drawers is portable upon a shoulder strap and dependable thereon in an upright situation during portage by connection of the shoulder strap to each of a pair of attachment points disposed upon the ovoid tote member proximal the domed lid.

4 Claims, 3 Drawing Sheets

OVOID TOTE WITH SECURABLE DRAWERS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of totes with securable compartments are known in the prior art. However, what is needed is an ovoid tote with securable drawers disposed to resemble a luxury jeweled egg, said ovoid tote with securable drawers including an ovoid tote member having a domed lid and a circular mirror disposed upon an undersurface of said domed lid, said domed lid openable to view the circular mirror and access a topmost compartment disposed thereunder, wherein an upper compartment is disposed underneath the topmost compartment, a lockable middle drawer is disposed for secure portage of valuables under the upper compartment, a lower compartment is disposed underneath the middle drawer, and a plurality of leg members maintain the ovoid tote member in an upright situation when deposited upon an underlying surface, whereby the ovoid tote member with securable drawers is portable upon a shoulder strap disposed to depend the ovoid tote member in an upright situation during portage by connection to each of a pair of attachment points disposed proximal the domed lid.

FIELD OF THE INVENTION

The present invention relates to an ovoid tote with securable drawers, and more particularly, to an ovoid tote with securable drawers disposed to resemble a luxury jeweled egg, said ovoid tote with securable drawers including an ovoid tote member having a domed lid and a circular mirror disposed upon an undersurface of said domed lid, said domed lid openable to view the circular mirror and access a topmost compartment disposed thereunder, wherein an upper compartment is disposed underneath the topmost compartment, a lockable middle drawer is disposed for secure portage of valuables under the upper compartment, a lower compartment is disposed underneath the middle drawer, and a plurality of leg members maintain the ovoid tote member in an upright situation when deposited upon an underlying surface, whereby the ovoid tote member with securable drawers is portable upon a shoulder strap disposed to depend the ovoid tote member in an upright situation during portage by connection to each of a pair of attachment points disposed proximal the domed lid.

SUMMARY OF THE INVENTION

The general purpose of the ovoid tote with securable drawers, described subsequently in greater detail, is to provide an ovoid tote with securable drawers which has many novel features that result in an ovoid tote with securable drawers which is not anticipated, rendered obvious, suggested, or even implied by prior art, either alone or in combination thereof.

The present ovoid tote with securable drawers has been devised to enable a handbag portable in a form reminiscent of a luxury, jeweled egg. The present ovoid tote member with securable drawers includes an ovoid tote member portable about the shoulders. The ovoid tote member is contemplated to be manufactured from a formed polymer, whereby the ovoid tote member is lightweight and durable.

A shoulder strap is disposed upon the ovoid tote member, said shoulder strap attached to the ovoid tote member at each of a pair of attachment points whereby the ovoid tote member is dependable from the shoulder strap in an upright situation during portage. The shoulder strap includes a strap portion disposed to comfortably overlie the shoulder of a person porting the ovoid tote member.

The strap portion is disposed medially between each of a pair of chain members, each of said pair of chain members attached endwise to each of the pair of attachment points. A plurality of decorative glass beads, reminiscent of precious stones, is intermittently disposed upon each of the pair of chain members. Each of the pair of attachment points is disposed more proximal the apex of the ovoid tote member whereby the ovoid tote member maintains an upright situation when ported by the shoulder strap.

A domed lid is disposed capping the ovoid tote member. The domed lid is hingedly moveable between a closed position and an open position. When moved to the closed position, the domed lid caps the ovoid tote member and embodies the apex thereof. The domed lid includes an undersurface, disposed to rest interiorly within the ovoid tote member when the domed lid is moved to the closed position. A circular mirror is disposed upon the undersurface, said circular mirror viewable when the domed lid is moved to the open position.

An illuminable member is disposed circumferentially bounding the circular mirror upon the undersurface of the domed lid. The illuminable member illuminates when the domed lid is moved to the open position whereby the circular mirror is highlighted for viewing, as desired.

A topmost compartment is disposed underneath the domed lid, said topmost compartment usable for storage of make up and accouterments, for example, among other objects preferably or desirably ported therein.

An upper compartment is disposed underneath the topmost compartment. The upper compartment is accessible when a first door is moved from a closed position, disposed flush with the exterior surface of the ovoid member, to an open position.

A middle drawer is disposed underneath the upper compartment. The middle drawer is disposed approximately equatorially upon the ovoid tote member. The middle drawer is slidable between a recessed position and an extended position. The middle drawer rests flush with the exterior surface of the ovoid tote member when moved to the recessed position.

The ovoid drawer is lockable in the recessed position, whereby valuables ported therein are securable and access thereto preventable absent a particular key. The middle draw may be operable between the recessed position and the extended position when unlocked by depression of the middle drawer, whereby the drawer automatically opens subsequent being depressed. Returning the middle drawer to the recessed position thence closes the drawer and sets said drawer flush within the exterior surface of the ovoid tote member.

A lower compartment is disposed underneath the middle drawer. The lower compartment is accessible when a second door is moved between a closed position and an open position. The lower compartment may likewise extend a drawer therefrom automatically when depressed.

A plurality of optional inserts is contemplated as part of the invention, said plurality of optional inserts including a plurality of drawers insertable into each of the upper and lower compartments, and interchangeable with the middle drawer, whereby a plurality of interior compartments is contemplated for customizable arrangement interior to the ovoid tote member. Moreover, each of the plurality of optional inserts is contemplated to include a variety of finishes for alternate display when disposed flush with the exterior surface of the ovoid tote member.

A money clip is also contemplated disposed on an underside of the middle drawer, wherein valuable items, such as cash and credit cards, are secretable for concealed storage therein.

Thus has been broadly outlined the more important features of the present ovoid tote with securable drawers so that the detailed description thereof that follows may be better understood and in order that the present contribution to the art may be better appreciated.

Objects of the present ovoid tote with securable drawers, along with various novel features that characterize the invention are particularly pointed out in the claims forming a part of this disclosure. For better understanding of the ovoid tote with securable drawers, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
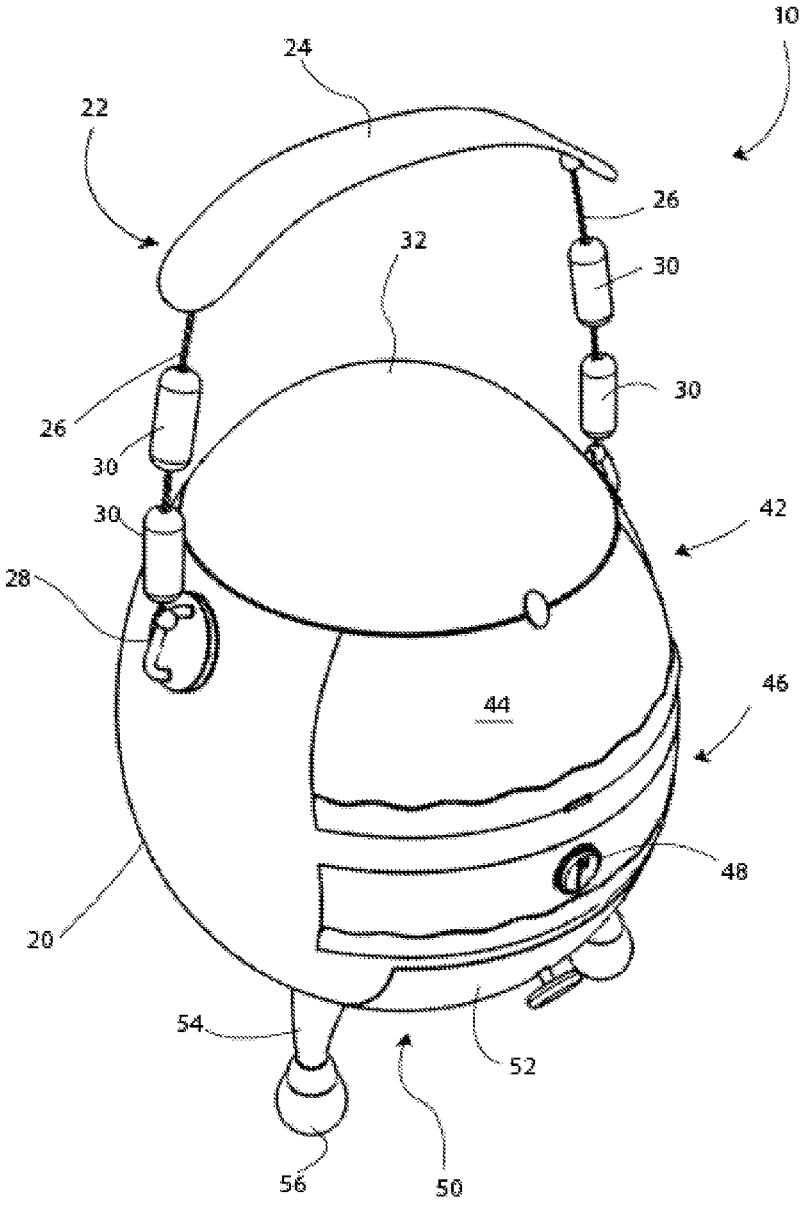
FIG. 1 is an isometric view.
Figure 2:
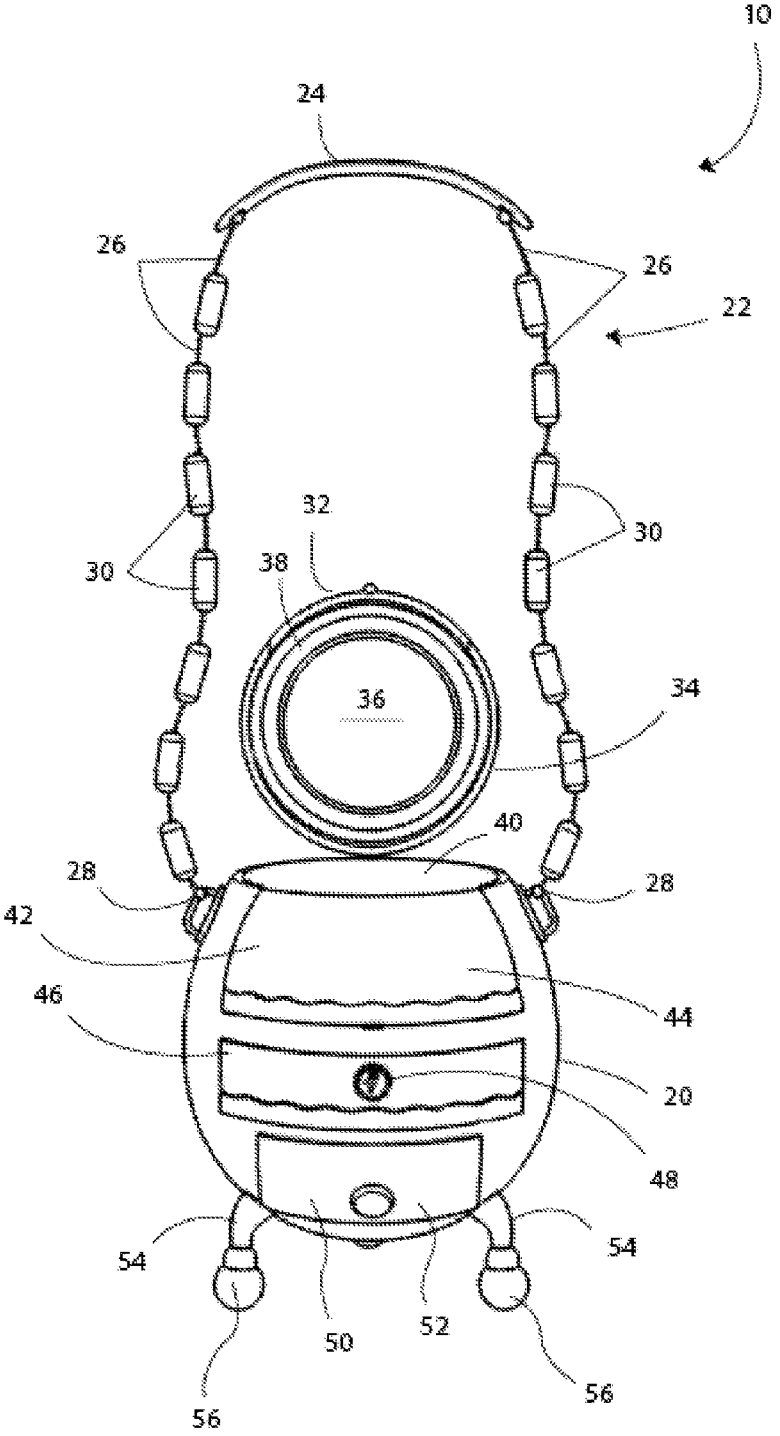
FIG. 2 is a front view with a domed lid disposed in an open position.
Figure 3:
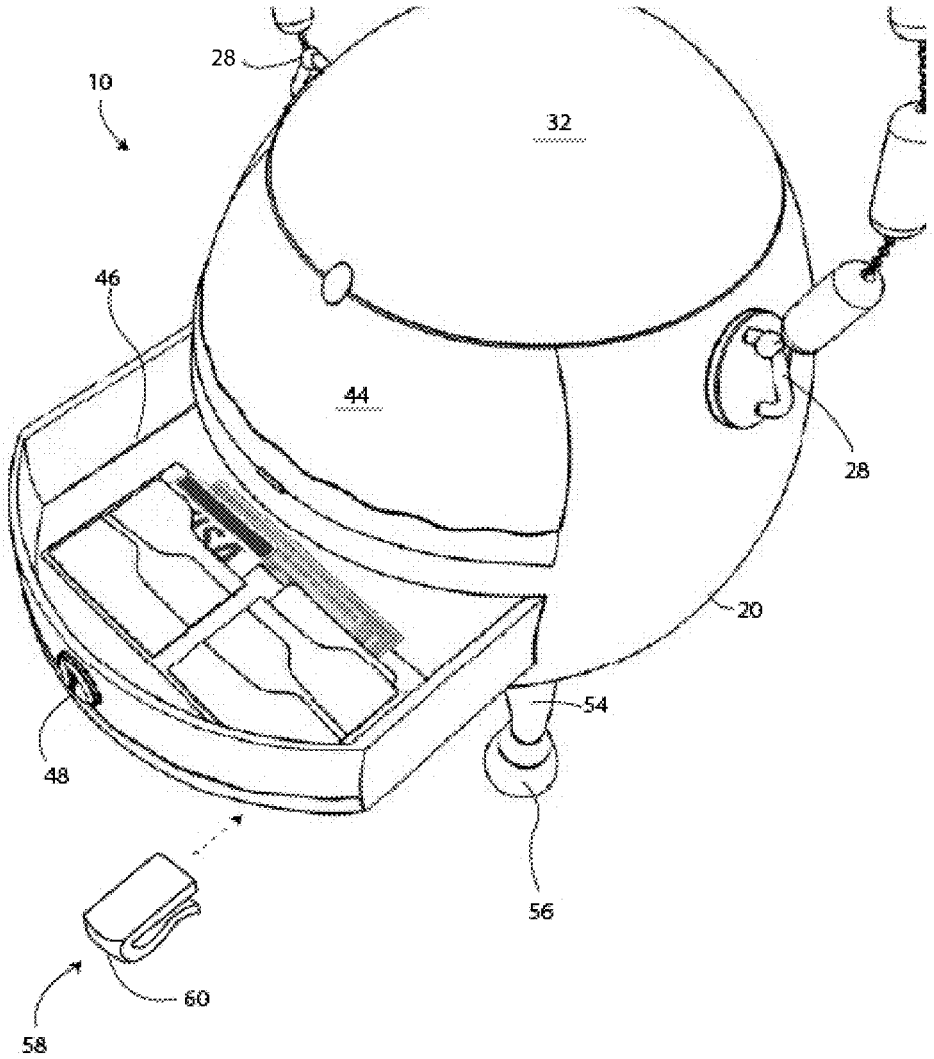
FIG. 3 is a detail view of an middle drawer disposed in an extended position.

With reference now to the drawings, and in particular FIGS. 1 through 3 thereof, example of the instant ovoid tote with securable drawers employing the principles and concepts of the present ovoid tote with securable drawers and generally designated by the reference number 10 will be described.

Referring to FIGS. 1 through 3 a preferred embodiment of the present ovoid tote with securable drawers 10 is illustrated.

The present ovoid tote with securable drawers 10 has been devised as a carry tote including an ovoid tote member 20 having a plurality of compartments therein. The ovoid tote member 20 is devised to resemble a luxury, jeweled egg, combining style with durability and a maximized interior volume relative surface area.

The present ovoid tote with securable drawers 10, therefore, includes an ovoid tote member 20 portable by means of a shoulder strap 22 attached thereto. The shoulder strap 22 includes a strap portion 24 disposed between each of a pair of chain members 26. Each of the pair of chain members 26 is attached to the ovoid tote member 20 at each of a pair of attachment points 28. The chain members 26 include a plurality of glass beads 30 disposed intermittently thereon as design elements reminiscent of precious stones.

A domed lid 32 is hingedly disposed capping the ovoid tote member 20. The domed lid 32 is moveable between an open position and a closed position. The domed lid 32 includes an undersurface 34 disposed interiorly within the ovoid tote member 20 when the domed lid 32 is moved to the closed position. A circular mirror 36 is disposed upon the undersurface 34 of the domed lid 32, said circular mirror 36 accessible and viewable when the domed lid 32 is moved to the open position.

An illuminable member 38 is disposed circumferentially bounding the circular mirror 36. The illuminable member 38 is illuminable when the domed lid 32 is opened to enable highlighted viewing of the circular mirror 36.

A topmost compartment 40 is disposed within the ovoid tote member 20, said topmost compartment 40 accessible when the domed lid 32 is opened. Make up and other accouterments are contemplated for exemplary storage in the topmost compartment 40 whereby a user viewing the mirror may conveniently access make up, as desired, while contemplating their reflection.

An upper compartment 42 is disposed underlying the topmost compartment 40, said upper compartment 42 accessible when a first door 44 is moved between a closed position and an open position. The first door 44 rests flush in the exterior surface of the ovoid tote member 20 when moved to the closed position.

A middle drawer 46 is disposed medially within the ovoid tote member 20, said middle drawer 46 slidable between a recessed position and an extended position. The middle drawer 46 is lockable in the recessed position by means of a key insertable into a lock member 48 disposed upon the middle drawer 46. The middle drawer 46 rests flush into the exterior surface of the ovoid tote member 20 when moved to the closed position.

The middle drawer 46 may automatically extend from the recessed position to the extended position when depressed by a user, whereby access to the middle drawer when unlocked as enabled by depression of the middle drawer 46. Subsequent movement of the middle drawer 46 back to the recessed position secures the middle drawer 46 in the recessed position, flush with the exterior surface of the ovoid tote member 20.

A lower compartment 50 is disposed underlying the middle drawer 46, said lower compartment 50 accessible when a second door 52 is moved between a closed position and an open position. The second door 52 may move when depressed inward and automatically extend a lower drawer outwards from the lower compartment 50. The second door 52 also rests flush in the exterior surface of the ovoid tote member 20 when moved to the closed position.

A plurality of leg members 54 is disposed basally upon the ovoid tote member 20, each of said plurality of leg members 54 disposed to supportively uphold the ovoid tote member 20 in an upright situation when placed upon an underlying surface. Each of said leg members 54 includes a spheroidal glass bead 56 disposed endwise thereon upon which each of said leg members 54 stands.

The ovoid tote with securable drawers 10 includes a plurality of optional inserts 58 interchangeable and dispositional interior to the ovoid tote member 20. The plurality of optional inserts includes, for example, a money clip 60 disposed on an underside of the middle drawer. The money clip 60 is disposed to conceal cash therein. Additional optional inserts 58 are contemplated, such as a variety of middle drawers interchangeable with a variety of interior compartments selectable for use, as desired.

In the preferred embodiment herein disclosed, the interior of the ovoid tote member 20 is contemplated to include silk lined leather. The ovoid tote member 20 is contemplated to be fabricated from formed polymer to be lightweight and durable and painted, tinted, or finished appropriate to resemble precious metal, metal leaf, or other high quality finish, such as leather, animal hides, fur, beads, sequins and other precious and semi-precious stones, and other fabrics, as desired.

What is claimed is:

1. An ovoid tote with securable drawers comprising an ovoid tote member suspended from a shoulder strap, said ovoid tote member having a topmost compartment securable beneath a domed lid disposed atop the ovoid tote member, at least one securable drawer transversely disposed in the ovoid tote member, and a plurality of leg members disposed to supportively uphold the ovoid tote member in an upright situation upon an underlying surface, wherein each of said plurality of leg members includes a spheroidal glass bead disposed endwise thereupon.

2. The ovoid tote with securable drawers of claim 1 wherein the shoulder strap comprises a strap portion disposed between a pair of chain members, said chain members having a plurality of glass beads disposed intermittently therein, whereby each of the pair of chain members connects to the ovoid tote member proximal the domed lid at each of a pair of attachment points.

3. The ovoid tote with securable drawers of claim 2 wherein the at least one securable drawer includes an upper compartment, a middle drawer, and a lower compartment.

4. The ovoid tote with securable drawers of claim 3 wherein the middle drawer is lockable in a closed position by a key.

* * * * *